United States Patent [19]

Riesmeier et al.

[11] Patent Number: 4,677,005

[45] Date of Patent: Jun. 30, 1987

[54] ADHESIVE APPLICATION PROCESS

[75] Inventors: Manfred Riesmeier, Rahden; Siemen Garlichs, Espelkamp, both of Fed. Rep. of Germany

[73] Assignee: Kolbus GmbH, Rahden, Fed. Rep. of Germany

[21] Appl. No.: 820,715

[22] Filed: Jan. 17, 1986

[30] Foreign Application Priority Data

Jan. 28, 1985 [DE] Fed. Rep. of Germany ..... 3502733

[51] Int. Cl.[4] ..... B05D 1/28

[52] U.S. Cl. ..... 427/428

[58] Field of Search ..... 427/428, 208.4; 118/210

[56] References Cited

U.S. PATENT DOCUMENTS 3,319,602 5/1967 Winkler et al. ..... 118/210 X

*Primary Examiner*—Bernard D. Pianalto

*Attorney, Agent, or Firm*—Chilton, Alix & Van Kirk

[57] ABSTRACT

A film of adhesive is deposited onto a linearly moving book block back through use of an applying roller which rotates at a preselected nominal speed relative to the velocity of the book block. The rotational speed of the applying roller relative to its nominal speed is varied to obtain optimum application of the adhesive, the variation in speed including an increase in speed for a short time upon establishment of contact between the roller and book block.

6 Claims, No Drawings

ADHESIVE APPLICATION PROCESS

BACKGROUND OF THE INVENTION

1. Field of the Invention

The present invention relates to the formation of adhesive coatings on moving objects and particularly to the application of an evenly dispersed layer of glue to a surface of a book block so as to enable the subsequent fixation of a backing material or the like. More specifically, this invention is directed to a process for depositing an evenly dispersed film of glue on the back of a book block, or any other similar article, with the aid of an applying roller. Accordingly, the general objects of the present invention are to provide novel and improved methods of such character.

2. Description of the Prior Art

While not limited thereto in its utility, the present invention will be described in connection with the application of glue to pre-formed book blocks which are being transported at a substantially constant speed by a linear conveyor system. It is well known in the art to employ a rotating application roller to transfer a film of glue to a book block so as to enable the subsequent affixation of paper to the back of the block or the fixing of a headband strip to the top and bottom of the block. Typically, the application roller will receive the glue which is to be subsequently transferred to the book block from a "dip and dosing" roller which runs in a reservoir containing glue, the roller contacting the surface of the glue. Thus, the applying roller will receive a film of glue from the dip and dosing roller and will transfer this film onto the moving book block. The applying roller is customarily moveable inwardly and outwardly in synchronism with the book block conveying system to cause the engagement and disengagement of the applying roller with the moving blocks. It is also known in the art to contour the applying roller, which may be fabricated from rubber, so that it is generally complimentary in shape to the back of the book block.

The prior art techniques for forming a film of glue on a moving book block have been characterized by two long-standing problems. These problems, which will be discussed in more detail below, include the inability to reliably and uniformly coat the entire surface which is to be covered with a film of the adhesive. The second problem has been the deposit of an excess of adhesive at the leading and/or trailing edges of the surface to be coated thus leading to the unacceptable application of glue to the cut edges of the sheets forming the book block. In either case, i.e., an incomplete gluing of the cover or a resulting "dirty" book block, the product must be rejected.

Regarding the first of the above-discussed problems, it is not possible to obtain precise conformity of the profile of the glue application roller to the shape of the back of the book block to which the film of adhesive is to be applied. In the first place, since the book blocks are comprised of paper, the size and shape thereof cannot be maintained within close tolerance. Secondly, since the same production equipment is employed for the manufacture of many different books, the cost of providing and storing an application roller for each different book block configuration would be prohibitive. Accordingly, since it is not practical and/or not possible to provide a profiled glue application roller which exactly fits the shape of the back of the book block to which the film of glue is to be applied, a complete coating with adhesive of the area on the book block to which the covering is to be affixed could not previously be obtained. In this regard, it is to be noted that when a roller having a profile which is flat relative to the back of the book block is employed, a film of glue having a generally parabolic shape is deposited. Accordingly, the corner areas of the back of the book block do not receive any glue. Conversely, if the curvature of a profiled glue application roller is greater than that of the book block, the middle area of the book block back will not receive any glue. In either case, inadequate gluing results from the fact that the profile of the application roller does not have time to adjust to the contour of the moving book block.

In an effort to overcome the above-discussed problem of inadequate gluing, it is known to position the applying roller so that it is awaiting arrival of the block, the roller subsequently moving with the block. This technique has the disadvantage that an excess of glue will be deposited on the front cut edge of the book block when that edge is engaged by the roller. This problem is magnified by the fact that the surface areas within the concave profile of the roller travel at different speeds, which are a function of roller circumference, relative to the book block. Typically, the applying roller will be caused to rotate at a "nominal" speed such that a point on its average circumference is travelling at a velocity which is slightly lower than the linear velocity of the book block. This results in the velocity of the middle, i.e., central or minimum diameter region of the roller being less than the linear speed of the book block. This speed differential, in turn, favors the deposition of excess glue at the cut edge.

SUMMARY OF THE INVENTION

The present invention overcomes the above-briefly discussed and other deficiencies and disadvantages of the prior art by providing a novel and improved technique for the application of glue to objects such as moving book block backs. The present invention is particularly well suited for application of glue using a profiled, i.e., concave, applying roller.

In accordance with the invention, the speed of the applying roller is increased at the time of or immediately prior to its making contact with a book block back, i.e., the rotational speed increase is substantially simultaneous with the establishment of contact between the applying roller and the moving block. Preferably, the speed of the applying roller is decreased when it disengages from the book block back. The present invention thus constitutes the exercise of control over the rotational speed of an application roller during the depositing of a film of adhesive such that the velocity of a point on the circumference of the roller will vary in steps relative to the linear velocity of the moving book block.

DESCRIPTION OF THE PREFERRED EMBODIMENT

In accordance with the present invention, a driven applying roller, which preferably has a concave profile, is dosed with glue and that glue is subsequently transferred to a surface, for example a book block back, in the form of a deposited film. The glue transfer occurs as a result of the applying roller rolling over the back of the book block. The applying roller will have a nominal speed of rotation, this nominal speed of rotation being selected so that a point on the adhesive carrying surface of the roller intermediate the minimum and maximum diameters of this surface will be travelling at a speed which is either equal to or slightly lower than the velocity of the moving book block. In accordance with the invention, the speed of rotation of the applying roller is increased for a short period of time immediately prior to the establishment of contact with the book block. It has been found that this increase in speed, measured at the above-mentioned point on the surface of the applying roller, should be in the range of ten percent to twenty percent.

The above-discussed increase in speed has been found to provide the unexpected result of transferring a relatively large amount of glue to the back of the book block at the time of establishment of contact between the applying roller and book block and that this initial large deposit of glue will subsequently be spread out and smoothed over the total area of the book block back. The increased speed of the applying roller relative to the linear speed of the book block also results in the "excess" of glue deposited at the edge of the block being pulled away from the edge by the roller and thus not running down onto the cut area at the leading edge to produce an unacceptable "dirtying".

Also in accordance with the present invention, it has been found preferable to reduce the speed of rotation of the applying roller below the nominal speed simultaneously with or just immediately before the disengagement thereof with the block back. The decrease in speed at the time of disengagement results in a diminished flow of glue and thus substantially eliminates the possibility of glue running down onto the cut area at the trailing edge of the book block.

Uncomplicated mechanical means, for example cams carried by the book block transport, can be employed to produce signals to control the increase and decrease in speed of the drive motor for the applying roller. Alternatively, optical sensors and associated control circuitry, which receives input signals commensurate with book block linear speed and length, may be used for this purpose.

To summarize the present invention, the speed of a glue application roller is controlled, generally in stepwise fashion, about a middle speed such that the speed is increased for a short time immediately prior to the establishment of contact between the application roller and the moving book block and the speed is decreased at the time of disengagement of the applying roller from the book block.

While a preferred embodiment has been described, various modifications and substitutions can be made thereto without departing from the spirit and scope of the invention. For example, the present invention may be employed in a glue applying system with a deviating applying roller as well as one with a fixed depositing roller. Accordingly, it is to be understood that the present invention has been described by way of illustration and not limitation.

What is claimed is:

1. In a process for the deposition of a film of adhesive on a portion of a linearly moving book block, the adhesive being transferred to the book block from a source by means of an applying roller which contacts the book block, the applying roller being caused to rotate at a preselected nominal speed relative to the linear speed of the book block, the improvement comprising:

increasing the speed of rotation of the applying roller relative to its nominal speed substantially simultaneously with the establishment of contact between the roller and the book block; and maintaining the increased speed of rotation of the applying roller for a period of time which is less than the period of contact between the roller and book block.

2. The process of claim 1 further comprising the step of:

reducing the rotational speed of the applying roller below said nominal speed substantially simultaneously with the interruption of contact between the applying roller and the book block.

3. The process of claim 1 wherein the step of increasing the speed of rotation of the applying roller comprises increasing the rotational speed thereof by at least ten percent relative to the said nominal speed.

4. The process of claim 3 wherein the step of increasing the speed of rotation of the applying roller further comprises limiting the rotational speed increase to twenty percent of the nominal speed of rotation of the applying roller.

5. The process of claim 4 further comprising the step of:

reducing the rotational speed of the applying roller below said nominal speed substantially simultaneously with the interruption of contact between the applying roller and the book block.

6. The process of claim 1 wherein said improvement further comprises the step of:

reducing the rotational speed of the roller below said nominal speed at the time of disengagement thereof from the object.

* * * * *